US011488739B2

(12) United States Patent
Sharov et al.

(10) Patent No.: US 11,488,739 B2
(45) Date of Patent: Nov. 1, 2022

(54) PLANT FOR ELECTROCHEMICAL DECONTAMINATION OF METAL RADIOACTIVE WASTE

(71) Applicants: JOINT STOCK COMPANY "ROSENERGOATOM", Moscow (RU); JOINT STOCK COMPANY "SCIENCE AND INNOVATIONS", Moscow (RU)

(72) Inventors: Aleksandr Nikitovich Sharov, Novovoronezh (RU); Boris Nikolaevich Shevchenko, Novovoronezh (RU); Mikhail Alekseevich Neupokoev, Novovoronezh (RU)

(73) Assignees: JOINT STOCK COMPANY "ROSENERGOATOM", Moscow (RU); JOINT STOCK COMPANY "SCIENCE AND INNOVATIONS", Moscow (RU)

( * ) Notice: Subject to any disclaimer, the term of this patent is extended or adjusted under 35 U.S.C. 154(b) by 58 days.

(21) Appl. No.: 16/627,732

(22) PCT Filed: Aug. 28, 2018

(86) PCT No.: PCT/RU2018/000565
§ 371 (c)(1),
(2) Date: Dec. 30, 2019

(87) PCT Pub. No.: WO2019/216786
PCT Pub. Date: Nov. 14, 2019

(65) Prior Publication Data

US 2021/0158985 A1 May 27, 2021

(30) Foreign Application Priority Data

May 11, 2018 (RU) ..... RU2018117551

(51) Int. Cl.
*G21F 9/00* (2006.01)
*G21F 9/34* (2006.01)

(52) U.S. Cl.
CPC ..... *G21F 9/004* (2013.01); *G21F 9/34* (2013.01)

(58) Field of Classification Search
CPC ..... G21F 9/00; G21F 9/004; G21F 9/34
USPC ..... 588/15
See application file for complete search history.

(56) References Cited

U.S. PATENT DOCUMENTS

2021/0225545 A1* 7/2021 Polkanov ..... F27B 1/21

* cited by examiner

*Primary Examiner* — Edward M Johnson
(74) *Attorney, Agent, or Firm* — J. Miguel Hernandez; James R. Gourley; Carstens & Cahoon, LLP

(57) ABSTRACT

Devices for eliminating radioactive contamination of radioactive waste by providing adaptive processing of the decontamination solution for reuse. The plant for electrochemical decontamination of metal radioactive waste includes a pipe equipped with shut-off valves, a radioactive waste processing module that comprises a unit for electrochemical decontamination connected by a ventilation channel to the ventilation module and pipe for decontamination solution supply and discharge equipped with shut-off valves. The plant is equipped with a decontamination solution preparation module connected with a pipe for decontamination solution supply and discharge, at least one pump, while the module for decontamination solution receiving is equipped with devices for cleaning and pH correction of decontamination solution, and the unit for electrochemical decontamination of metal radioactive waste, the module for decontamination solution receiving and the decontamination solution preparation module are equipped with pH measurement elements.

14 Claims, 1 Drawing Sheet

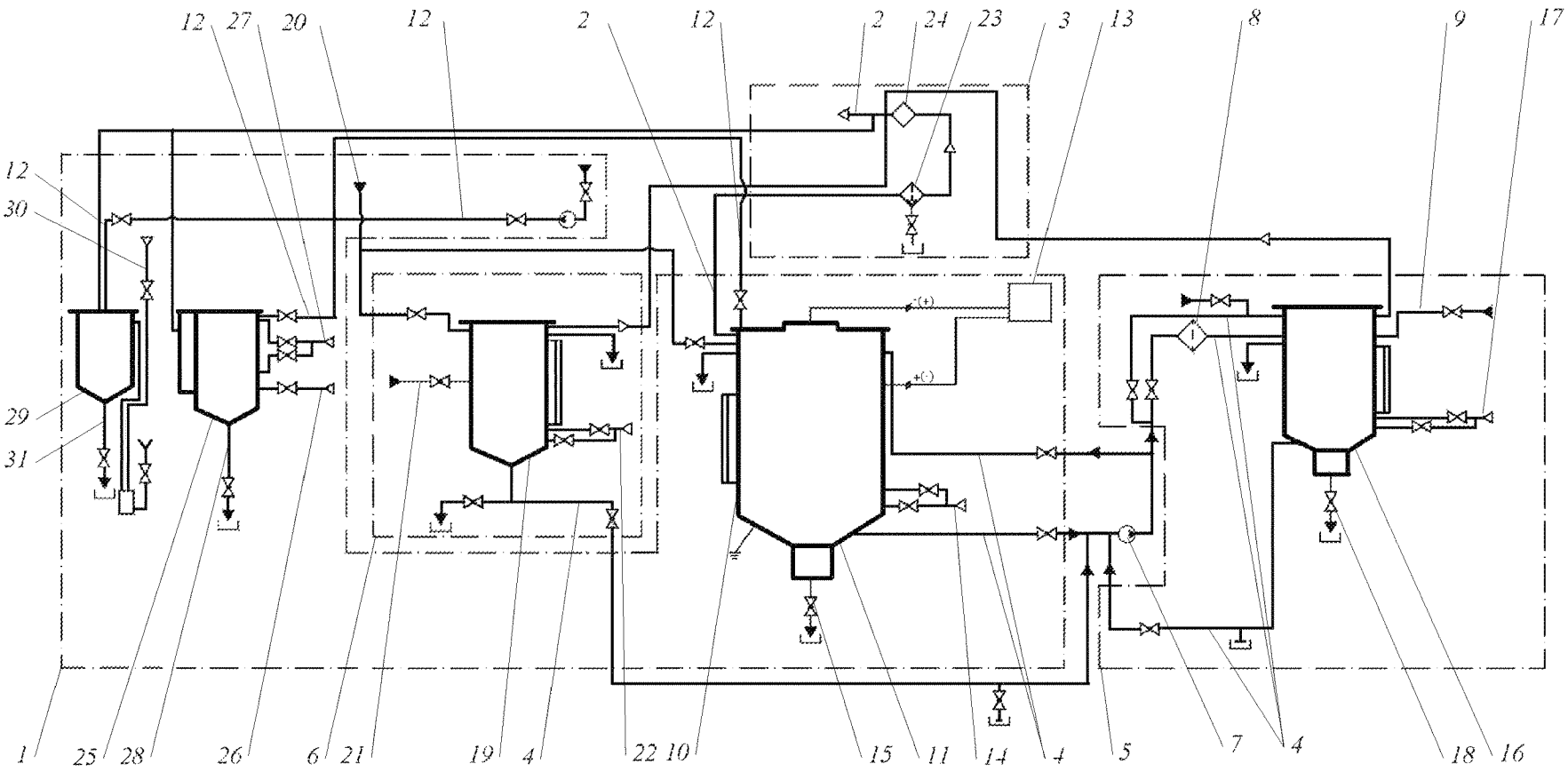
17
9
8
13
3
23
24
2
12
2
12
20
27
12
12
30
29
31
1
25
28
26
6
21
19
4
22
10
15
11
14
4
5
7
4
18
16

PLANT FOR ELECTROCHEMICAL DECONTAMINATION OF METAL RADIOACTIVE WASTE

CROSS-REFERENCE TO RELATED APPLICATIONS

This application is a US 371 application from PCT/RU2018/000565 filed Aug. 28, 2018, which claims priority to Russian Application No. RU 2018117551 filed May 11, 2018, the technical disclosures of which are hereby incorporated herein by reference.

The invention relates to devices for eliminating radioactive contamination of radioactive waste, namely, plants for electrochemical decontamination of metal radioactive waste.

The plant for electrochemical decontamination of the upper duct carrier of uranium-graphite nuclear reactors is known (the RF patent for invention No. 2096845) that comprises a water supply pipe, a cathode placed in an electrolyte-filled bath and connected to a DC source, an anode also connected to a DC source and connected to a treated metal radioactive waste item.

The disadvantages of the known plant, besides limiting the possibility of decontaminating only structural elements of channel-type reactors of the RBMK 1000 and 1500 type, are also the absence of the process automation and the need for a certain preparation of the decontamination solution, the need for additional quality control of the decontamination solution during the electrochemical decontamination process, the need for further collection of the spent decontamination solution, its recycling or disposal, as well as the need to provide exhaust ventilation of the bath or of the device itself.

The closest technical solution chosen as a prototype is a device for electrochemical decontamination of metal surfaces (the RF patent for utility model No. 127237) that comprises a replaceable electrode, bundles of electrically conductive material fastened in it that are in contact with the surface being decontaminated, electrolyte distribution chamber, waste electrolyte collection chamber and gas collection chamber, whilst each of the chambers is equipped with at least one nozzle, wherein the electrode is connected with the electrolyte distribution chamber. Despite the fact that this plant allows achieving a higher current density on the electrodes at equal voltage, its disadvantages are the need to provide the plant with a prepared decontamination solution, the need to control the quality of the decontamination solution during the electrochemical decontamination process and the need for further processing or disposal of the spent decontamination solution.

The task of the claimed invention is to expand the functionality of the plant and increase the efficiency of the use of decontamination solution.

The technical result achieved by the claimed invention is to provide adaptive processing of the decontamination solution for reuse with a simultaneous increase of the decontamination solution processing speed and improvement of its quality for reuse.

The said technical result is achieved due to the fact that the plant for electrochemical decontamination of metal radioactive waste includes a pipe equipped with shut-off valves, a radioactive waste processing module that comprises a unit for electrochemical decontamination of metal radioactive waste connected by a ventilation channel to the ventilation module and pipe for decontamination solution supply and discharge equipped with shut-off valves and, with the module for decontamination solution receiving. According to the claimed solution, the plant is equipped with a decontamination solution preparation module connected with a pipe for decontamination solution supply and discharge, equipped with at least one pump, with a unit for electrochemical decontamination of metal radioactive waste and a module for decontamination solution receiving, whilst the module for decontamination solution receiving is equipped with devices for cleaning and pH correction of decontamination solution, and the unit for electrochemical decontamination of metal radioactive waste, the module for decontamination solution receiving and the decontamination solution preparation module are equipped with pH measurement elements.

Wherein the unit for electrochemical decontamination of metal radioactive waste may include a cylindrical working container with a lower conical part, a basket for the metal radioactive waste treated element inside the working container, a high-pressure water supply pipe and a pipe for decontamination solution supply and discharge equipped with shut-off valves connected with the working container, a DC source, the negative output of which is connected according to the cathode circuit, and a positive output is connected according to the anode circuit with the basket for the metal radioactive waste treated element, a mixing device connected with the working container, a precipitation discharge unit located in the lower part of the working container, and an ionizing radiation power monitoring device, a temperature monitoring device and a decontamination solution level monitoring device that are connected with the working container.

In addition, the module for decontamination solution receiving may include a decontamination solution processing container connected with the pipe for decontamination solution supply and discharge equipped with an ion-selective filter, and an alkaline substance supply pipe equipped with shut-off valves, the ionizing radiation power monitoring device, the mixing device, the precipitation discharge device located in the lower part of the decontamination solution processing container, and the decontamination solution level monitoring device located inside the decontamination solution processing container, that are connected with the decontamination solution processing container.

The decontamination solution preparation module may include a decontamination solution preparation container that is connected with supply pipes for water and acidic substances, and the pipe for decontamination solution supply and discharge that are equipped with shut-off valves, a mixing device connected with decontamination solution preparation container, and the decontamination solution level monitoring device installed inside the decontamination solution preparation container.

Primarily, the ventilation module includes a ventilation duct, a water separator and a hydrogen post-combustion device that are installed in it.

The radioactive waste processing module may include a metal radioactive waste degreasing unit equipped with a container for metal radioactive waste degreasing that is connected with a degreasing solutions supply pipe, high-pressure water, steam and air supply pipes equipped with shut-off valves, a pH measuring device and a precipitation discharge device connected with the container for metal radioactive waste degreasing.

In addition, the radioactive waste processing module may include an etching unit for non-metal coatings of metal radioactive waste equipped with a container for etching of non-metal coatings of metal radioactive waste that is connected with acidic substances supply pipe, high-pressure water and air supply pipes equipped with shut-off valves, a pH measuring device and a precipitation discharge device connected with the container for etching of non-metal coatings of metal radioactive waste.

Also, the radioactive waste processing module may include a flushing unit connected by a high-pressure water supply pipe equipped with shut-off valves with the unit for electrochemical decontamination of metal radioactive waste, the metal radioactive waste degreasing unit, and the etching unit for non-metal coatings of metal radioactive waste.

In addition, the decontamination solution preparation module, the module for decontamination solution receiving, the metal radioactive waste degreasing unit and the etching unit for non-metal coatings of metal radioactive waste can be connected with the ventilation module by a ventilation duct.

The pipe for decontamination solution supply and discharge can be designed to transfer the decontamination solution from the decontamination solution preparation module to the unit for electrochemical decontamination of metal radioactive waste and the module for decontamination solution receiving, from the unit for electrochemical decontamination of metal radioactive waste to the module for decontamination solution receiving, from the module for decontamination solution receiving to the unit for electrochemical decontamination of metal radioactive waste.

The claimed invention is shown in the drawing that explains the invention. The FIGURE shows the pneumatic-hydraulic diagram of the plant for electrochemical decontamination of metal radioactive waste.

The claimed technical solution is a plant for electrochemical decontamination of metal radioactive waste, is explained by a specific design described below, however, the given example is not the only possible, but it clearly demonstrates the possibility of achieving this set of essential features of the claimed technical result.

The plant for electrochemical decontamination of metal radioactive waste includes a radioactive waste processing module 1 that comprises a unit for electrochemical decontamination of metal radioactive waste connected by a ventilation duct 2 with a ventilation module 3. In addition, the plant for electrochemical decontamination of metal radioactive waste includes a pipe equipped with shut-off valves, which are valves, taps, gate valves, damper valves. In addition, the unit for electrochemical decontamination of metal radioactive waste is connected by a pipe 4 for decontamination solution supply and discharge equipped with shut-off valves, with a module 5 for decontamination solution receiving.

The plant for electrochemical decontamination of metal radioactive waste is also equipped with a decontamination solution preparation module 6 that is connected by the pipe 4 for decontamination solution supply and discharge with the unit for electrochemical decontamination of metal radioactive waste and the module 5 for decontamination solution receiving. The pipe 4 for decontamination solution supply and discharge is equipped with a pump 7. The module 5 for decontamination solution receiving is equipped with a decontamination solution cleaning device made in the form of an ion-selective filter 8, and a device for pH correction of decontamination solution that comprises an alkaline substance supply pipe 9.

In addition, the unit for electrochemical decontamination of metal radioactive waste, the module 5 for decontamination solution receiving and the decontamination solution preparation module 6 are equipped with pH measurement elements (not shown in the FIGURE).

The unit for electrochemical decontamination of metal radioactive waste includes a cylindrical working container 10 with a lower conical part 11, a basket (not shown in the FIGURE) for the metal radioactive waste treated element (not shown in the FIGURE) installed inside the working container, the high-pressure water supply pipe 12 equipped with shut-off valves, as well as the pipe 4 for decontamination solution supply and discharge that are connected with the working container 10, as mentioned above.

For the purposes of electrochemical deactivation, the unit for electrochemical decontamination of metal radioactive waste is provided with a DC source 13, the negative output of which is connected according to the cathode circuit, and a positive output is connected according to the anode circuit with a basket for the metal radioactive waste treated element. In addition, the unit for electrochemical decontamination of metal radioactive waste includes a mixing device 14 of the working container 10 that supplies compressed air to the cylindrical working container 10 connected with it, a precipitation discharge unit 15 located in the lower part of the working container 10. For the purposes of the decontamination solution condition monitoring, the unit for electrochemical decontamination of metal radioactive waste is equipped with an ionizing radiation power monitoring device (not shown in the FIGURE), a temperature monitoring device (not shown in the FIGURE) and a decontamination solution level monitoring device (not shown in the FIGURE) that are connected with the working container 10.

In this embodiment, the module 5 for decontamination solution receiving includes a decontamination solution processing container 16 connected with the pipe 4 for decontamination solution supply and discharge equipped with an ion-selective filter 8, and an alkaline substance supply pipe 9 equipped with shut-off valves, the ionizing radiation power monitoring device (not shown in the FIGURE), the mixing device 17 supplying compressed air to the decontamination solution processing container 16 connected with it, the precipitation discharge device 18 located in the lower part of the decontamination solution processing container 16, and the decontamination solution level monitoring device (not shown in the FIGURE) located inside the decontamination solution processing container 16, that are connected with the decontamination solution processing container 16.

The decontamination solution preparation module 6 includes a decontamination solution preparation container 19 connected with a water supply pipe 20 equipped with shut-off valves, an acidic substance supply pipe 21 equipped with shut-off valves, and a pipe 4 for decontamination solution supply and discharge, the mixing device 22 of the decontamination solution preparation container 19 connected with the decontamination solution preparation container 19 supplying compressed air to the connected decontamination solution preparation container 19, and a decontamination solution level monitoring device installed inside the decontamination solution preparation container 19 (not shown in the FIGURE).

The ventilation module 3 includes a ventilation duct 2, a water separator 23 and a hydrogen post-combustion device 24 that are installed in it.

The radioactive waste processing module 1 includes a metal radioactive waste degreasing unit containing a container 25 for metal radioactive waste degreasing connected with a degreasing solutions supply pipe (not shown in the FIGURE) equipped with shut-off valves, a high-pressure water supply pipe 12 equipped with shut-off valves, a steam supply pipe 26 equipped with shut-off valves, and an air supply pipe 27 equipped with shut-off valves, a pH measuring device (not shown in the FIGURE) and a precipitation discharge device 28 that are connected with a container 25 for metal radioactive waste degreasing.

Also, the radioactive waste processing module 1 additionally includes an etching unit for non-metal coatings of metal radioactive waste containing a container 29 for etching of non-metal coatings of metal radioactive waste connected with an acidic substances supply pipe (not shown in the FIGURE) equipped with shut-off valves, a high-pressure water supply pipe 12 equipped with shut-off valves, and an air supply pipe 30 equipped with shut-off valves, a pH measuring device (not shown in the FIGURE) and a precipitation discharge device 31 that are connected with a container 29 for etching of non-metal coatings of metal radioactive waste.

The radioactive waste processing module 1 includes a flushing unit connected by a high-pressure water supply pipe 12 equipped with shut-off valves with the unit for electrochemical decontamination of metal radioactive waste, the metal radioactive waste degreasing unit, and the etching unit for non-metal coatings of metal radioactive waste.

The decontamination solution preparation module 6, the module 5 for decontamination solution receiving, the metal radioactive waste degreasing unit and the etching unit for non-metal coatings of metal radioactive waste are connected with the ventilation module 3 by a ventilation duct 2.

The pipe 4 for decontamination solution supply and discharge is designed to transfer the decontamination solution from the decontamination solution preparation module 7 to the unit for electrochemical decontamination of metal radioactive waste and the module 5 for decontamination solution receiving. In addition, the pipe 4 for decontamination solution supply and discharge is designed to transfer the decontamination solution from the unit for electrochemical decontamination of metal radioactive waste to the module 5 for decontamination solution receiving and back.

The plant for electrochemical decontamination of metal radioactive waste works as follows.

The calculated amount of water is supplied to the decontamination solution preparation container 19 of the module 6 via the water supply pipe 20. Next, acidic substances (e.g., nitric acid) are supplied via the pipe 21, whilst the supply level of these substances is monitored by the decontamination solution level monitoring device. After this, the solution is mixed (bubbled) with compressed air supplied by the mixing device 22 with a simultaneous monitoring of the resulting solution pH level using a measurement element. Simultaneously with the bubbling from the decontamination solution preparation container 19, the air is removed by the ventilation duct 2 of the ventilation module 3. The prepared decontamination solution is supplied by pump 7 via the pipe 4 for decontamination solution supply and discharge into the working container 10 of the unit for electrochemical decontamination of metal radioactive waste of the module 1, while the element(s) of metal radioactive waste is(are) preliminarily installed in the basket of the working container 10.

In the case of the presence of metal radioactive waste of non-metal deposits (contamination) on the element(s), the specified element(s) is(are) preliminarily subjected to chemical degreasing and etching described below.

After filling the working container 10 with a decontamination solution to the calculated level, which is monitored by the decontamination solution level monitoring device, electric current is supplied using the source 13 according to the scheme where the negative output is connected according to the cathode circuit, and a positive output is connected according to the anode circuit with the basket for the metal radioactive waste treated element. Simultaneously with the filling of the working container 10 with a decontamination solution, the solution is mixed by compressed air (bubbling) supplied by a mixing device 14. During the decontamination process, the solution pH level, the temperature and the power of ionizing radiation are monitored using measuring elements. The air containing hydrogen and water vapour is removed by a ventilation channel 2 of a module 3 through a water separator 37 and a hydrogen post-combustion device 38.

After the decontamination process is completed, the decontamination solution is completely discharged by a pump 7 through a pipe 4 for decontamination solution supply and discharge into a decontamination solution processing container 16 of a module 5 through an ion-selective filter 8.

At the same time, the ion-selective filter 8 installed in the pipe 4 for decontamination solution supply and discharge is designed to clean the contaminated spent decontamination solution (electrolyte) flowing from the container 10 from the Cz137, Co60 radionuclides (isotopes of technogenic origin) by precipitating them in the inorganic selective sorbent phase.

The operating time until the absorption capacity of the filter 8 has been exhausted and the transport and technological operation for its transfer to the place of organized long-term storage are determined during the development of the technology and design binding to a specific facility. The filling of the filter 8 cavity with inorganic selective sorbent to the design capacity of its body is performed at the place of use. Project sorbents have selective ability to radionuclides Cz137 and Co60.

After discharge of the decontamination solution from the container 10, the treated (deactivated) element(s) of metal radioactive waste is(are) subjected to hydrodynamic processing using a high-pressure water supply pipe 12, while this processing can be performed outside the container 10 in the absence of a high pressure water supply pipe 12 in the plant for electrochemical decontamination of metal radioactive waste. The precipitations remaining in the working container 10 are discharged using the precipitation discharge unit 15 located in the conical part 11 of the working container 10.

The module 5 for decontamination solution receiving is designed to neutralize contaminated spent decontamination solution containing nitric acid with sodium hydroxide and calcium. The solution pH and the ionizing radiation power are monitored using measuring elements in the decontamination solution processing container 16 of the module 5. Based on the obtained measurements, sodium and calcium hydroxide is supplied using an alkaline substance supply pipe 9 to a container 16 with a simultaneous mixing (bubbling) of the solution by compressed air supplied by a mixing device 17. Next, the solution pH and the power of ionizing radiation are repeatedly monitored. On the basis of the data obtained, the decision is taken to re-process the spent decontamination solution or about the readiness of the purified decontamination solution to be supplied to the working container 10 of the electrochemical decontamination unit.

The container 16 is cleaned from the remnants of the radionuclides of the corrosion group by precipitating them in the sludge after opening the shut-off valve 18. During the cleaning of the spent decontamination solution in the container 16, the air is removed by the ventilation duct 2 of the ventilation module 3.

In the case of a shortage of purified decontamination solution in the container 16, the level of which is monitored using a decontamination solution level monitoring device, the previously prepared decontamination solution is topped up from a decontamination solution preparation container 19 of a module 6 by supplying decontamination solution with a pump 7 via pipe 4 for decontamination solution supply and discharge in the container 16 of a module 5 for decontamination solution receiving.

The prepared calculated amount of the purified decontamination solution is supplied from the container 16 of the module 5 for decontamination solution receiving using a pump 7 via the pipe 25 for decontamination solution supply and discharge to the working container 10 of the unit for electrochemical decontamination of metal radioactive waste of a module 1. At the same time, the same treated element(s) of metal radioactive waste is(are) installed in the basket of the working container 13, if it is necessary to repeat its decontamination, or a new treated element(s) of metal radioactive waste is present, the decontamination procedure is repeated as described above.

As mentioned above, in the case of the presence of metal radioactive waste of non-metal deposits (contamination) on the element(s), prior to the electrochemical decontamination, chemical degreasing and etching are carried out.

For degreasing, the treated element(s) of metal radioactive waste is(are) installed in the container 25 of the metal radioactive waste degreasing unit of the radioactive waste processing module 1. Next, highly alkaline degreasing solutions, in particular, soda ash, and heating steam, are supplied via the degreasing solution supply pipe (not shown in the FIGURE) and the steam supply pipe 26 to the container 25. At the same time, pressurized air is supplied to the container 25 for mixing of the above substances, which ensures effective degreasing of the surface of the treated element(s) of metal radioactive waste by an air supply pipe 27. After the degreasing process, the surface of the treated element(s) of metal radioactive waste is(are) subjected to hydrodynamic processing using a high-pressure water supply pipe 12, while this processing can be performed outside the container 25 in the absence of a high pressure water supply pipe 12 in the plant for electrochemical decontamination of metal radioactive waste. During the degreasing, the air is removed from the container 25 by the ventilation duct 2 of the ventilation module 3.

After the hydrodynamic processing, sediments, mainly consisting of non-metal deposits (contamination), are unloaded from the container 25 by a device 28.

After the hydrodynamic processing, the element(s) of metal radioactive waste is(are) installed in the container 29 of the etching unit for non-metal coatings of metal radioactive waste of the radioactive waste processing module 1. Next, acidic substances, mainly sulfuric or hydrochloric or phosphoric acids, are supplied via the acidic substance supply pipe to the container 29. At the same time, pressurized air is supplied to the container 29 for mixing of the acidic substances, which ensures effective etching of the surface of the element(s) of metal radioactive waste by an air supply pipe 30. After the etching process, the surface of the treated element(s) of metal radioactive waste is(are) subjected to hydrodynamic processing using a high-pressure water supply pipe 12, while this processing can be performed outside the container 29 in the absence of a high pressure water supply pipe 12 in the plant for electrochemical decontamination of metal radioactive waste. During the etching, the air is removed from the container 29 by the ventilation duct 2 of the ventilation module 3.

After the hydrodynamic processing, sediments, mainly consisting of non-metal deposits (contamination), are unloaded from the container 29 by a device 31.

The invention claimed is:

1. An electrochemical decontamination plant for radioactive waste metal, comprising:

a pipeline equipped with shutoff valves, a treatment module for radioactive waste metal comprising an electrochemical decontamination module for radioactive waste metal;

a ventilation channel;

a ventilation module;

decontamination solution supply and discharge pipeline having shutoff valves and at least one pump;

a decontamination solution receipt module; and decontamination solution preparation module;

the electrochemical decontamination module connected via the ventilation channel with the ventilation module, and the electrochemical decontamination module connected with the decontamination solution receipt module via the decontamination solution supply and discharge pipeline equipped with the shutoff valves;

the decontamination solution preparation module connected via the decontamination solution supply and discharge pipeline and the at least one pump to the electrochemical decontamination module for radioactive waste metal and to the decontamination solution receipt module;

the decontamination solution receipt module being equipped with decontamination solution treatment and pH correction devices;

the electrochemical decontamination module for radioactive waste metal, the decontamination solution receipt module and the decontamination solution preparation module are equipped with pH measurement components.

2. The electrochemical decontamination of plant for radioactive waste metal according to claim 1, wherein the electrochemical decontamination module for radioactive waste metal comprises: a cylindrical tank with a conical bottom; a basket for a treated component of radioactive waste metal installed inside the tank; a high-pressure water supply pipeline equipped with shutoff valves; a direct current source; a negative terminal of the direct current source connected to a cathode of the electrochemical decontamination module for radioactive waste metal, and a positive terminal of the direct current source connected to (i) an anode of the electrochemical decontamination module for radioactive waste metal and (ii) the basket for the treated component of radioactive waste; a mixing device connected to the tank; a sediment discharge unit located in a bottom of the tank; an ionizing radiation dose rate monitor connected to the tank; a temperature monitor connected to the tank; and a decontamination solution monitor connected to the tank;

the decontamination solution supply and discharge pipeline being connected to the tank.

3. The electrochemical decontamination plant for radioactive waste metal according to claim 1, wherein the decontamination solution receipt module comprises:

an alkaline agents supply pipeline equipped with shutoff valves;

a decontamination solution processing container connected to the decontamination solution supply and discharge pipeline, the decontamination solution supply and discharge pipeline equipped with an ion indicating filter, and the decontamination solution processing container connected to the alkaline agents supply pipeline equipped with shutoff valves;

an ionizing radiation monitor connected to the decontamination solution processing container;

a mixing device connected to the decontamination solution processing container;

sediment discharge device located in a bottom of and connected to the decontamination solution treatment container; and and a decontamination solution level monitor located inside and connected to the decontamination solution processing container.

4. The electrochemical decontamination plant for radioactive waste metal according to claim 1, wherein the decontamination solution preparation module comprises:

water acid agents supply pipelines equipped with a shutoff valve;

a decontamination solution preparation container connected to the water, the acid agents supply pipelines equipped with the shutoff valve, and the decontamination solution supply and discharge pipeline equipped with shut-off valves;

a mixing device connected to the decontamination solution preparation container; and a decontamination solution level monitor installed inside the decontamination solution preparation container.

5. The electrochemical decontamination plant for radioactive waste metal according to claim 1, wherein the ventilation module comprises the ventilation channel, a moisture separator, and a hydrogen burner installed therein.

6. The electrochemical decontamination plant for radioactive waste metal according to claim 1, wherein the treatment module for radioactive waste metal comprises a radioactive waste metal degreasing unit, the radioactive waste metal degreasing unit comprising:

pipelines equipped with shutoff valves and supplying degreasing solutions, high pressure water, steam and air;

a radioactive waste metal degreasing container connected to the pipelines equipped with shutoff valves and supplying degreasing solutions, high pressure water, steam and air;

a pH meter connected to the radioactive waste metal degreasing container; and a sediment discharge device connected to the radioactive waste metal degreasing container.

7. The electrochemical decontamination of plant for radioactive waste metal according to claim 1, wherein the treatment module for radioactive waste metal comprises a non-metallic coating etching unit for radioactive waste metal, the non-metallic coating etching unit for radioactive waste metal comprising:

pipelines equipped with shutoff valves and supplying acid agents, high pressure water and air;

a container for non-metallic etching of radioactive waste metal, the container for non-metallic coating etching of radioactive waste metal connected to the pipelines equipped wth shutoff valves and supplying acid agents, high pressure water and air;

a pH meter connected to the container for non-metallic coating etching of radioactive waste metal; and a sediment discharge device connected to the container for non-metallic coating etching of radioactive waste metal.

8. The electrochemical decontamination of plant for radioactive waste metal according to claim 1, wherein the treatment module for radioactive waste comprises a flush unit, the flush unit connected with a high pressure water supply pipeline to the electrochemical decontamination module for radioactive waste metal, a radioactive waste metal degreasing unit, and a non-metallic coating etching unit for radioactive waste metal; the high pressure water supply pipeline equipped with shutoff valves.

9. The electrochemical decontamination plant for radioactive waste metal according to claim 1, wherein the decontamination solution preparation module, the decontamination solution receipt module, a radioactive waste metal degreasing unit, and a non-metallic coating etching unit for radioactive waste metal are connected to the ventilation module via the ventilation channel.

10. The electrochemical decontamination of plant for radioactive waste metal according to claim 1, wherein the decontamination solution supply and discharge pipeline is designed to transfer decontamination solution:

(i) from the decontamination solution preparation module to the electrochemical decontamination module for radioactive waste metal and the decontamination solution receipt module, (ii) from the electrochemical decontamination module for radioactive waste metal to the decontamination solution receipt module, and (iii) from the decontamination solution receipt module to the electrochemical decontamination module for radioactive waste metal.

11. The electrochemical decontamination plant for radioactive waste metal according to claim 6, wherein the treatment module for radioactive waste comprises a flush unit, the flush unit connected with a high pressure water supply pipeline to the electrochemical decontamination module for radioactive waste metal, the radioactive waste metal degreasing unit and a non-metallic coating etching unit for radioactive waste metal; the high pressure water supply pipeline equipped with shutoff valves.

12. The electrochemical decontamination plant for radioactive waste metal according to claim 7, wherein the treatment module for radioactive waste comprises a flush unit, the flush unit connected with a high pressure water supply pipeline to the electrochemical decontamination module for radioactive waste metal, a radioactive waste metal degreasing unit and the non-metallic coating etching unit for radioactive waste metal; the high pressure water supply pipeline equipped with shutoff valves.

13. The electrochemical decontamination plant for radioactive waste metal according to claim 6, wherein the decontamination solution preparation module, the decontamination solution receipt module, the radioactive waste metal degreasing unit, and a non-metallic coating etching unit for radioactive waste metal are connected to the ventilation module via the ventilation channel.

14. The electrochemical decontamination plant for radioactive waste metal according to claim 7, wherein the decontamination solution preparation module, the decontamination solution receipt module, a radioactive waste metal degreasing unit, and the non-metallic coating etching unit for radioactive waste metal are connected to the ventilation module via the ventilation channel.

* * * * *